US007082787B2

(12) United States Patent
Lee et al.

(10) Patent No.: US 7,082,787 B2
(45) Date of Patent: Aug. 1, 2006

(54) REFRIGERATION SYSTEM

(75) Inventors: Guang-Chung Lee, Houston, TX (US); Rian Reyneke, Katy, TX (US); Michael J. Foral, Aurora, IL (US); Christos Papadopoulos, Naperville, IL (US); Wayne W. Y. Eng, League City, TX (US); Jeff Logsdon, Naperville, IL (US)

(73) Assignee: BP Corporation North America Inc., Warrenville, IL (US)

( * ) Notice: Subject to any disclaimer, the term of this patent is extended or adjusted under 35 U.S.C. 154(b) by 330 days.

(21) Appl. No.: 10/796,608

(22) Filed: Mar. 9, 2004

(65) Prior Publication Data

US 2005/0198998 A1 Sep. 15, 2005

(51) Int. Cl.
*F25J 1/00* (2006.01)
*F25J 3/00* (2006.01)

(52) U.S. Cl. ..... 62/612; 62/620; 62/623

(58) Field of Classification Search ..... 62/612, 62/620, 623
See application file for complete search history.

(56) References Cited

U.S. PATENT DOCUMENTS

| | | | | |
|---|---|---|---|---|
| 3,593,535 | A | 7/1971 | Gaumer, Jr. | 62/23 |
| 3,763,658 | A | 10/1973 | Gaumer, Jr. et al. | 62/40 |
| 5,379,597 | A | 1/1995 | Howard | 62/23 |
| 5,430,223 | A | 7/1995 | Bauer | 585/800 |
| 6,253,574 | B1 | 7/2001 | Stockmann et al. | 62/612 |
| 6,347,531 | B1 | 2/2002 | Roberts et al. | 62/612 |
| 2002/0174679 | A1 | 11/2002 | Wei | 62/612 |

*Primary Examiner*—Melvin Jones
*Assistant Examiner*—B. Clayton McCraw
(74) *Attorney, Agent, or Firm*—James R. Henes

(57) ABSTRACT

The recovery of ethylene from light gases at low temperature by the use of a mixed refrigeration system comprising methane, ehtylene and/or ethane, and propylene and/or propane.

9 Claims, 5 Drawing Sheets

REFRIGERATION SYSTEM

BACKGROUND OF THE INVENTION

1. Field of the Invention

The present invention pertains to the recovery of ethylene from light gases at low temperature, and more particularly to an improved mixed refrigeration system comprising (1) methane (2) ethylene and/or ethane, and (3) propylene and/or propane to provide more efficient refrigeration for such recovery.

2. Description of the Prior Art

Mixed refrigerant systems have been well known in the industry for many decades. In these systems, multiple refrigerants are utilized in a single refrigeration system to provide refrigeration covering a wider range of temperatures, enabling one mixed refrigeration system to replace multiple pure component cascade refrigeration systems. These mixed refrigeration systems have found widespread use in base load liquid natural gas plants.

Gaumer et al., U.S. Pat. No. 3,593,535 (Jul. 20, 1971) and U.S. Pat. No. 3,763,658 (Oct. 9, 1973); Stockmann et al., U.S. Pat. No. 6,253,574 (Jul. 3, 2001); and Roberts et al., U.S. Pat. No. 6,347,531 (Feb. 19, 2002); and Kinard et al., "Mixed Refrigerant Cascade Cycles for LNG," Chemical Engineering Progress; Vol. 69, No. 1, pages 56–61 (January 1973), disclose methods for liquefying gas, especially natural gas, that employ multicomponent refrigeration systems. None of these methods are employed for the recovery of ethylene and separation therefrom of methane. Bauer, U.S. Pat. No. 5,430,223 (Jul. 4, 1995) discloses a refrigeration system for use in the separation of higher hydrocarbons from their gas mixture with lower boiling components, but not the separation of methane from ethylene.

Ethylene plants require refrigeration to separate out desired products from the cracking heater effluent. Typically, a $C_3$ refrigerant, usually propylene, and a $C_2$ refrigerant, typically ethylene, are used. Often, particularly in systems using low pressure demethanizers where lower temperatures are required, a separate methane refrigeration system is also employed. Thus, three separate refrigeration systems are required, cascading from the lowest temperature to the highest. Three compressor and driver systems complete with suction drums, separate exchangers, piping, etc., are required. Also, a methane refrigeration cycle often requires reciprocating compressors which can partially offset any capital cost savings resulting from the use of low pressure demethanizers. Hence, the use of a mixed refrigerant system is highly desirable.

Howard et al., U.S. Pat. No. 5,379,597 (Jan. 10, 1995) discloses a method for recovering ethylene from a feed gas containing ethylene, hydrogen and $C_1$ to $C_3$ hydrocarbons, which includes the steps of compressing and cooling the feed gas to condense a portion thereof, fractionating the condensed feed gas liquids in one or more demethanizer columns to recover a light overhead product comprising chiefly hydrogen and methane, and fractionating the one or more demethanizer column bottoms streams to recover an ethylene product and streams containing $C_2$ and heavier hydrocarbons. The refrigeration cycle employed for this recovery involves condensing and subcooling a mixed refrigerant vapor. The resulting subcooled liquid is split in two portions, each of which is subsequently flashed. One such portion is at least partially vaporized in the demethanizer column overhead condenser to provide reflux to that column. The other such portion is at least partially vaporized in cooling the feed gas. The resulting vapor refrigerant portions are recombined.

Wei, published U.S. patent application No. U.S. 2002/0174679 A1, published on Nov. 28, 2002 discloses a refrigeration system for an ethylene plant that comprises a tertiary refrigerant containing methane, ethylene and propylene. In the closed loop system, a portion of the constant composition refrigerant from the compressor is separated into a methane-rich vapor portion and a propylene-rich liquid portion. The various refrigerant streams are then used to cool the charge gas to separate the $C_2$ and heavier hydrocarbons from the hydrogen and methane. The separated refrigerant streams are then recombined to form the constant composition before recycle to the compressor.

It is highly desirable to provide refrigeration using a mixed refrigeration system that provides refrigeration at a lower temperature and a greater degree of control over the relative cooling duties of the heat exchangers.

SUMMARY OF THE INVENTION

The present invention is a method for the recovery of ethylene from a feed gas comprising methane, ethylene, and hydrogen, wherein the recovery comprises the steps of compressing and cooling the feed gas to condense a portion thereof, fractionating the resulting condensed feed gas liquid in at least one demethanizer column to recover a light overhead product comprising substantially hydrogen and methane, and recovering an ethylene-containing product from the bottoms stream from the at least one demethanizer column, wherein cooling and demethanization of the feed gas is provided by a refrigeration process comprising the steps of: (a) compressing from a first pressure to a second pressure a gaseous mixed refrigerant stream comprising methane, ethane and/or ethylene, and propane and/or propylene having a preselected composition; (b) cooling and partially condensing the aforesaid mixed refrigerant stream and separating a vapor refrigerant stream having an increased percentage of methane and a liquid refrigerant stream having an increased percentage of propylene and/or propane; (c) cooling the vapor stream from step (b) to produce an at least partially condensed vapor stream and cooling at least the vapor portion thereof to produce in at least one step a subcooled liquid stream; (d) flashing the subcooled liquid stream from step (c) to a third pressure which is above the aforesaid first pressure and at least partially vaporizing the resulting depressurized stream by indirect heat exchange with the demethanizer overhead to thereby provide refrigeration for the demethanizer condenser; (e) cooling the liquid stream from step (b) and the liquid portion if any, of the aforesaid partially condensed vapor stream from step (c), flashing them to the aforesaid third pressure, and combining them with the at least partially vaporized stream from step (d) either before or after or both before and after the at least partially vaporized stream from step (d) undergoes further heating, to thereby form an at least partially vaporized combined stream having the aforesaid preselected composition; (f) completely vaporizing the combined stream from step (e) by indirect heat exchange thereof with the feed gas to thereby provide refrigeration to cool the feed gas; and (g) recycling the completely vaporized mixed refrigerant stream from step (f) to step (a).

BRIEF DESCRIPTION OF THE DRAWINGS

For a more complete understanding of this invention, reference should now be made to the embodiments illustrated in greater detail in the accompanying drawings and described below by way of examples of the invention.

Figure 1:
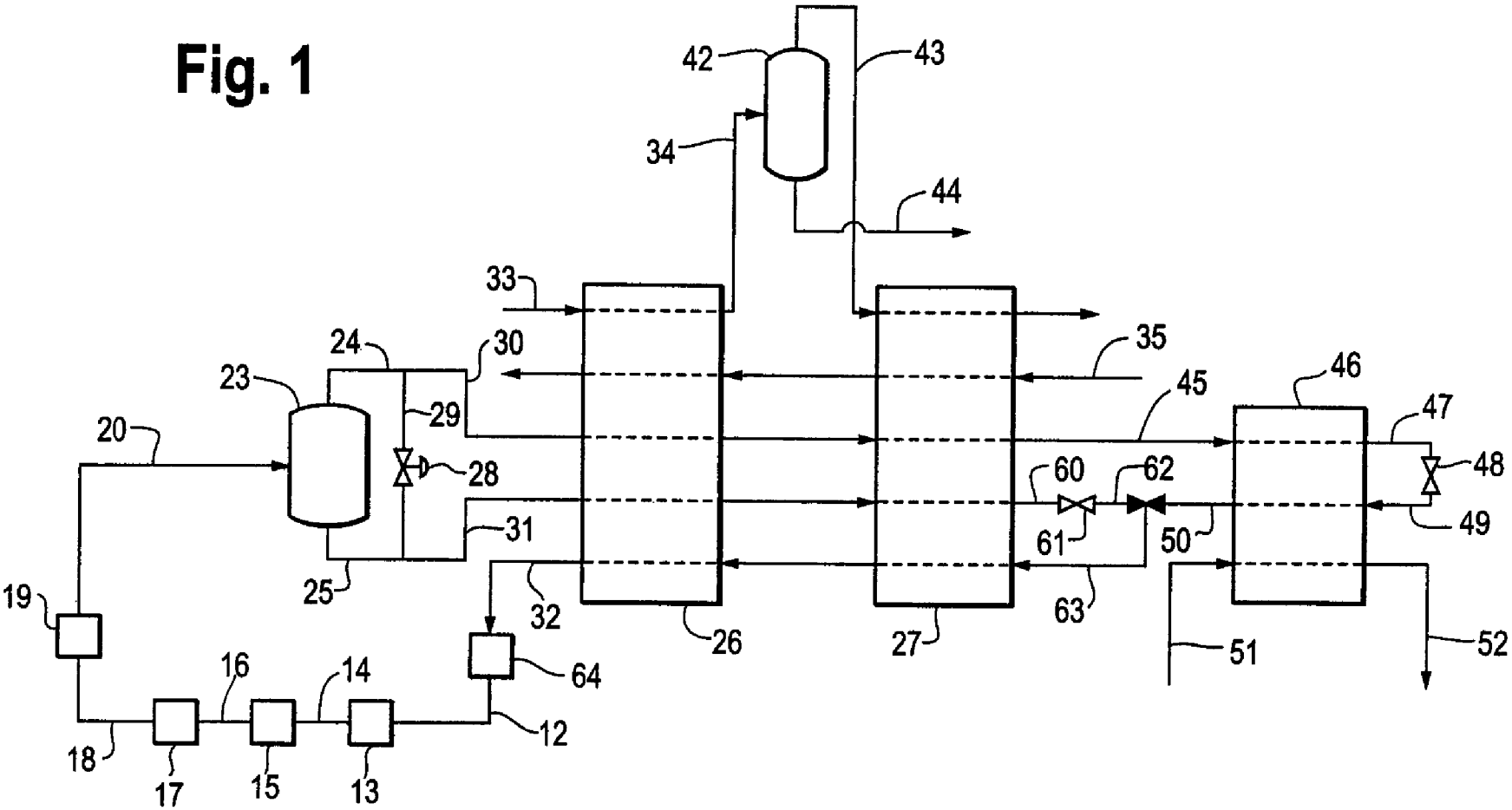
FIGS. 1–3 are schematic illustrations of preferred embodiments of the refrigeration system employed in the method of this invention.

It should be remembered that the drawings are not to scale and are schematic in nature. In certain instances, details which are not necessary for an understanding of the present invention or which render other details difficult to perceive may be omitted. It should be understood, of course, that the invention is not necessarily limited to the particular embodiments illustrated herein.

DETAILED DESCRIPTION OF THE PREFERRED EMBODIMENTS

Although the mixed refrigerant system of the present invention can be used to recover ethylene, ethane or heavier hydrocarbons from numerous feed gases containing ethylene, hydrogen and C1 to C3 hydrocarbons, for example, from a refinery or petrochemical offgas, or ethylene plant, it will be exemplified primarily in the recovery of ethylene from an ethylene plant and from an offgas stream from a refinery fluidized catalytic cracking (FCC) unit. Preferably the feed gas comprises from 3 to 50 mole percent of methane, from 10 to 45 mole percent of ethylene, and from 5 to 50 mole percent of hydrogen. When the feed gas comprises cracked gas from a hydrocarbon cracker, preferably the cracked gas comprises from 15 to 50 mole percent of methane, from 10 to 30 mole percent of ethylene, and from 5 to 25 mole percent of hydrogen. When the feed gas comprises the offgas stream from a refinery fluidized catalytic cracking unit, preferably the feed gas comprises from 3 to 35 mole percent of methane, from 20 to 45 mole percent of ethylene, and from 10 to 50 mole percent of hydrogen.

The recovery of ethylene from a feed gas containing ethylene, hydrogen, and $C_1$ to $C_3$ hydrocarbons includes the steps of compressing the feed gas, cooling the compressed feed gas to condense a portion thereof, in single stage condensers (or cold boxes against re-heat streams) or alternatively in one or more dephlegmators which impart several stages of separation during the condensation step. The condensate is separated from lighter gases and is passed to one or more demethanizer columns which recover a light overhead gas comprising chiefly methane and hydrogen, and a bottoms stream rich in $C_2$ and $C_3$ hydrocarbons. This hydrocarbon stream is typically further fractionated to yield a high purity ethylene product, an ethane-rich byproduct, and a stream of $C_3$ and heavier hydrocarbons. Typically at least a portion of the uncondensed hydrogen-methane vapor stream from the final ethylene recovery step is sent to a conventional hydrogen recovery section to produce a high-purity hydrogen product and one or more methane-rich streams.

In one preferred embodiment, the present invention involves an ethylene plant, wherein a pyrolysis gas is first processed in a known manner to produce and separate ethylene as well as propylene and some other by-products. The separation of the gas in an ethylene plant through condensation and fractionation at cryogenic temperatures requires refrigeration over a wide temperature range. The capital cost involved in the refrigeration system of a ethylene plant can be a significant part of the overall plant cost. Therefore, capital savings for the refrigeration system will significantly affect the overall plant cost.

Essentially all ethylene plants use an ethylene-propylene cascade refrigeration system to provide the major portion of refrigeration required in the ethylene plant. Most of the propylene (high level) refrigeration is utilized at several pressure/temperature levels in the initial feed precooling and fractionation sections of the plant to cool the feed from ambient temperature to about −35° F. and to condense the ethylene refrigerant at about −30° F. Similarly, the ethylene (low level) refrigeration is utilized at several pressure/temperature levels in the cryogenic section of the plant to cool the feed from −35° F. to about −145° F. in order to condense the bulk of the ethylene in the form of liquid feeds to a demethanizer column, and in the demethanizer column overhead condenser at about −150° F. to provide reflux to that column. Ethylene is normally not used to provide refrigeration below −150° F. since that would result in sub-atmospheric pressure at the suction of the ethylene compressor. Refrigeration below −150° F. to condense the remaining ethylene from the feed, is provided primarily by work expansion of the rejected light gases hydrogen and methane, and/or by vaporization of methane refrigerant which has been condensed by ethylene refrigerant. The work expanded gases are normally used as fuel and consist primarily of the overhead vapor from the demethanizer column, mostly methane, and any uncondensed feed gas, mostly hydrogen and methane, which is not processed in the hydrogen recovery section of the ethylene plant, and cold hydrogen-rich and methane-rich streams from the hydrogen recovery section.

With the conventional process technology described above, the feed gas chilling and demethanizing must be carried out at pressures in the range of 450 to 650 psia in order to achieve high ethylene recovery (99% or more) because the propylene/ethylene cascade system can provide refrigeration no colder than −150° F. for feed gas chilling and for demethanizer column condenser refrigeration. The amount of refrigeration for feed cooling below −150° F. which can be produced from other process streams in an ethylene plant is limited by operating constraints such as the amount of high pressure hydrogen recovered and the fuel system pressure(s). These constraints limit the amount of expander refrigeration which can be produced, which in turn limits the ethylene recovery. Pressures between 450 and 650 psia are required in the feed gas chilling train and in the demethanizer column so that most of the ethylene can be condensed above −150° F., and so that sufficient fuel gas expansion refrigeration at colder temperatures is available to condense most of the remaining ethylene and achieve low ethylene loss in the demethanizer column overhead vapor.

The tertiary refrigerant of the present invention comprises a mixture of methane, ethylene and/or ethane, and propylene and/or propane. The percentages of these components vary depending on the ethylene plant cracking feedstock, the cracking severity and the chilling train pressure among other considerations, but will generally be in the range of 5 to 40 mole percent methane, 40 to 70 mole percent ethylene and/or ethane and 5 to 20 mole percent propylene and/or propane. A typical composition would be 30 mole percent methane, 60 mole percent ethylene and 10 mole percent propylene. The use of the tertiary refrigerant provides the refrigeration load and temperatures required for an ethylene plant having a relatively low-pressure demethanizer while obviating the need for two or three separate refrigerant systems. The tertiary refrigerant of this invention can also be used with a high-pressure demethanizer. In that case, the tertiary system can be designed to provide ethylene and propylene levels of refrigeration. The methane content in the refrigerant would then be 5 to 12 percent.

The key aspects of the refrigeration system of this invention include one or more steps of partial condensation and vapor/liquid separation of the mixed refrigerant. This produces a relatively light uncondensed vapor and one or more relatively heavy condensed liquid streams. The vapor and at least one of the liquid streams are cooled against vaporizing mixed refrigerant. The relatively light vapor stream is utilized primarily to provide refrigeration for the demethanizer condenser. The relatively heavy liquid stream or streams are used primarily to chill and partially condense process gases. The vaporized relatively light vapor stream from the demethanizer condenser is combined with the subcooled and flashed relatively heavy liquid stream before vaporizing the subcooled flashed liquid stream to provide process chilling. The combination of these elements has been found to be particularly beneficial for providing refrigeration to a process for the recovery and purification of ethylene. The purpose of the present invention is to provide the necessary refrigeration for the feed gas to separate out the hydrogen and methane and provide the feed for the demethanizer. The improved closed-loop mixed refrigeration system of the present invention reduces the capital cost for refrigeration and provides operational stability.

Referring to FIG. 1, in a preferred embodiment of this invention, a mixed refrigerant stream 12 comprising of a combination of the components methane, ethane, ethylene, propane, and propylene is charged to a mixed refrigerant compressor system. This compressor system can be a single stage or multi-stage compressor. The compressor system in FIG. 1 depicts a two-stage compressor system. The first stage 13 compresses the mixed refrigerant stream from an initial pressure to an intermediate pressure. The compressor discharge, stream 14, can be cooled with an intercooler exchanger 15. Depending on the composition of the mixed refrigerant and the temperature exiting the intercooler 15, some partial condensation of stream 14 may occur. In this case the vapor and liquid would be separated and the liquid pumped around the subsequent stages of compression (not shown in FIG. 1).

Stream 16, the uncondensed vapor from the intercooler 15, enters the second stage of compression 17 in which it is compressed to a final pressure. The resulting compressed mixture, stream 18, is cooled in exchanger 19. In practice exchanger 19 would typically be made up of multiple exchangers to cool stream 18 across a relatively wide temperature range. One of the exchangers represented by 19 could effect heat transfer between stream 18 and a refrigeration stream from a separate loop, such as a propylene refrigeration system. Stream 18 is partially condensed in exchanger 19, and the vapor and liquid phases are passed in stream 20 to drum 23 where the vapor and liquid are separated. The vapor is relatively enriched in the lighter components of the mixed refrigerant stream and the liquid is relatively enriched in the heavier components.

The relatively light vapor, stream 24, and the relatively heavier liquid, stream 25, are directed to exchangers 26 and 27. Depending on the composition of the mixed refrigerant and the cooling requirements of the system, it may be desirable to direct some of the liquid in stream 25 into the vapor stream 24, or to direct some of the vapor in stream 24 into the liquid stream 25. For simplicity, FIG. 1 depicts a simple control valve 28 on stream 29 to facilitate the transfer between the vapor and liquid streams. Those skilled in the art will realize that additional valves may be required to reduce the pressure of stream 24 or 25 to enable the transfer of material through stream 29.

Figure 2:
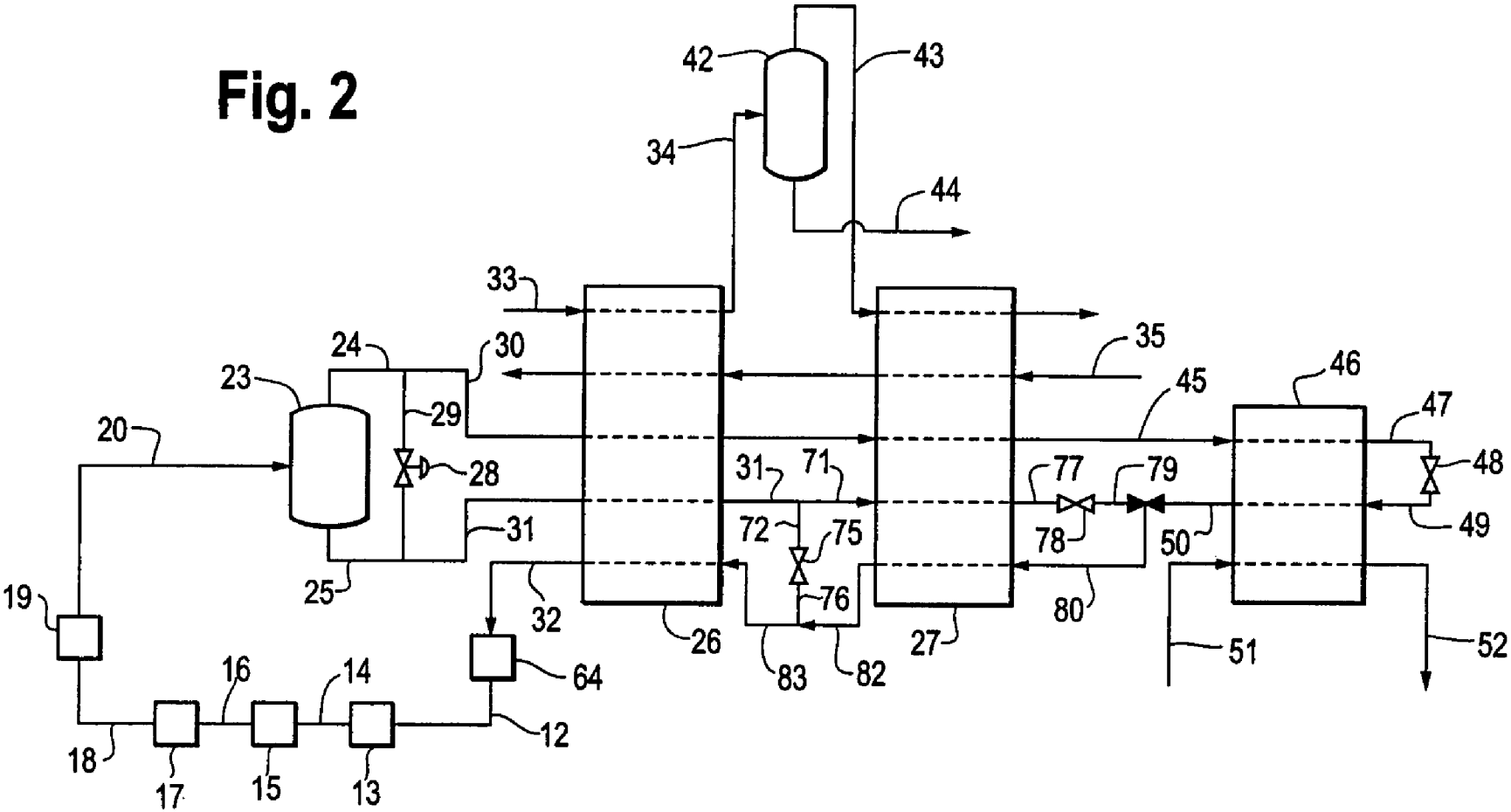
Figure 3:
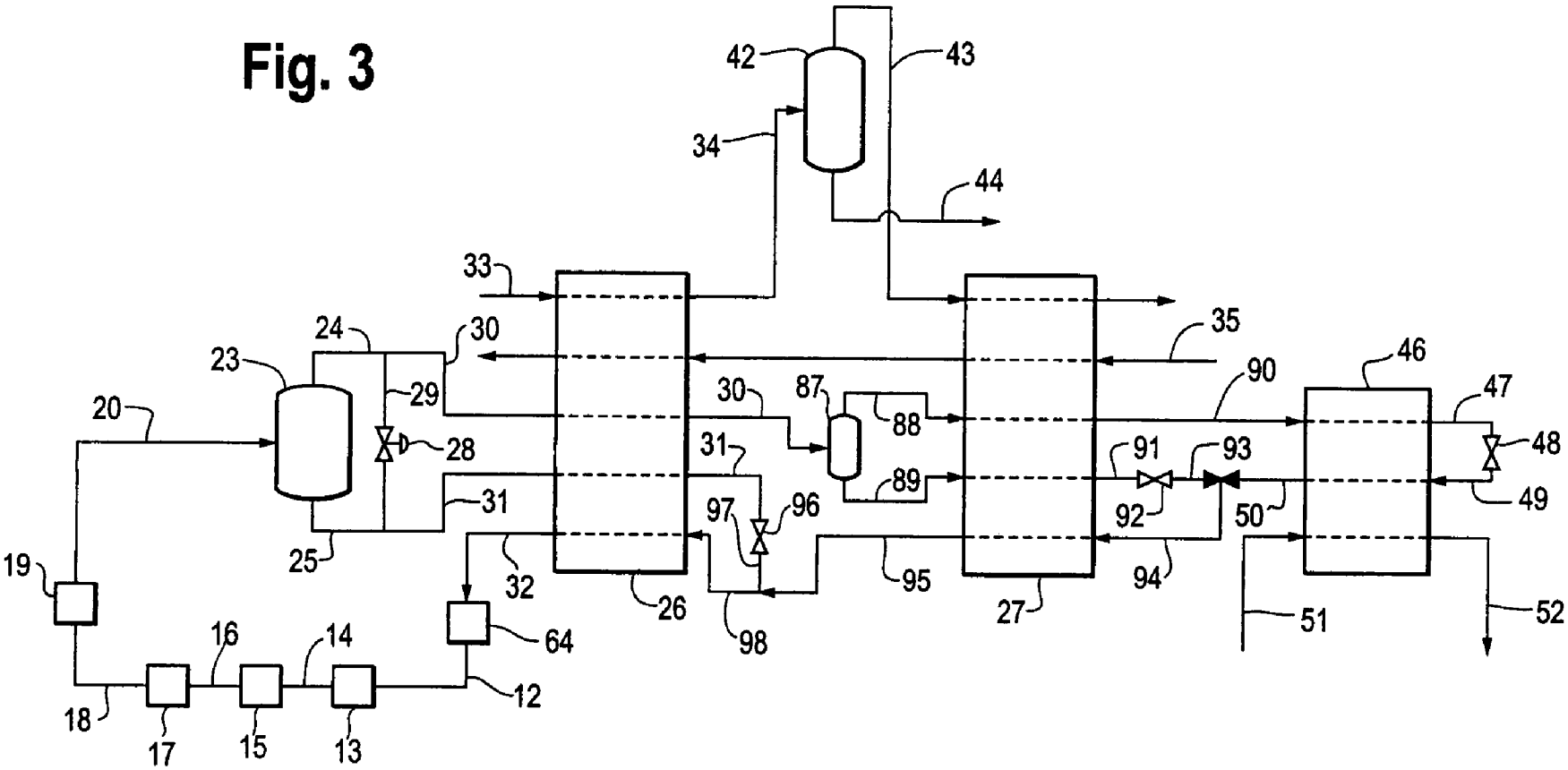

Exchangers 26 and 27 are multi-pass heat exchangers for high-pressure cryogenic service. The main purpose of 26 is to facilitate the indirect transfer of heat between the mixed refrigerant streams 30, 31, and 32, the process stream or streams to be cooled (represented by the single stream 33), and process streams to be reheated (represented by the single stream 35). The process stream to be cooled would typically be the mixed gas stream containing at least hydrogen, methane and ethylene. As the mixed gas stream is chilled in 26, it is typically partially condensed. In a typical ethylene application the partially condensed process stream would be removed at an intermediate point of the chilling process. Thus in FIG. 1 the partially chilled stream 34 is removed from 26 and the vapor and liquid are separated in drum 42. The vapor from 42, stream 43, is typically subjected to further chilling in 27. The liquid from the drum 42, stream 44, is typically directed to the demethanizer column (not shown) for separation of methane from the stream. It is well known that additional stages of chilling and vapor/liquid separation can be carried out on the process gas stream. For example, stream 43 could be removed from 27 and subjected to another vapor/liquid separation step, then further chilled in a subsequent step. In order to more clearly illustrate the present invention, the processes shown in FIGS. 1–3 depict only a single chilling and vapor/liquid separation step for the process gas (stream 33, 43 and 44).

The process stream 35 to be reheated could include net demethanizer overhead, relatively low-pressure methane product, and net hydrogen product. Although FIG. 1 shows the process streams to be cooled and reheated as contacting each other and the mixed refrigerant streams along the entire length of exchangers 26 and 27, those skilled in the art will recognize that these multiple streams can each enter or be withdrawn from 26 or 27 at any point along the length of the exchangers, depending on the initial temperature and desired final temperature of the individual streams.

The relatively light vapor stream 30 is cooled in exchangers 26 and 27. The resulting cooled stream 45 may be partially condensed, completely condensed, or a subcooled liquid depending on the composition of stream 30 and the detailed design of 26 and 27. This stream enters exchanger 46, which serves as a demethanizer condenser exchanger. Stream 45 is further cooled as it passes through exchanger 46. Any vapor existing in stream 45 is condensed and the liquid is subcooled as it passes through exchanger 46. A liquid/vapor separator drum (not shown) can optionally be installed on stream 47 to separate out any incondensable gases from the stream.

The pressure of the resulting subcooled liquid stream 47 is reduced to a level slightly above that of stream 12. This pressure reduction could be done with a simple valve (48 in FIG. 1) or through some form of work expansion. The flashed stream 49 is directed back to exchanger 46 to provide refrigeration through the heating and partial vaporization of liquid present in stream 49. The resulting partially vaporized stream 50 exits from the exchanger 46. Demethanizer overhead vapor enters exchanger 46 in stream 51 and exits as partially condensed stream 52, the liquid portion of which is directed back to the demethanizer tower as reflux.

The relatively heavy liquid stream 31 is subcooled in exchangers 26 and 27, and the pressure of the subcooled liquid stream 60 is reduced to a level approximately equal to that of stream 50 and slightly above that of stream 12. This pressure reduction could be done with a simple valve (61 in FIG. 1) or through some form of work expansion. Stream 60 is flashed, and the resulting stream 62 is then combined with the vaporized stream 50, and the combined stream 63 is sent back to exchanger 27 and 26. The liquid in the combined stream 63 is completely vaporized in exchangers 27 and 26 so that stream 32 exiting exchanger 26 contains no liquid. This stream is optionally reheated in exchanger 64 before being fed back to the first stage of compression.

Thus, in the embodiment of FIG. 1, in aforesaid step (c) of the method of this invention the entire at least partially condensed vapor stream is cooled to produce in at least one step the subcooled liquid stream, and in aforesaid step (e) the entire cooled depressurized liquid stream from aforesaid step (b) is combined with the at least partially vaporized stream from aforesaid step (d) before the stream from aforesaid step (d) undergoes further heating to thereby form a combined stream having the aforesaid preselected composition.

There are a number of ways in which the refrigeration system of FIG. 1 can be modified and still retain the key concepts of this invention. FIG. 2 shows a second embodiment of this invention. Many of the streams and process steps in FIG. 2 are the same or similar in function to those in FIG. 1. Streams, exchangers, drums, columns, valves, and compressors in FIG. 2 that serve the same or similar functions to those in FIG. 1 are numbered the same as those in FIG. 1. Only those aspects of the second embodiment (FIG. 2) that are different from the first embodiment (FIG. 1) are discussed below.

The primary difference in the second embodiment is that the relatively heavy liquid stream 31 is split into two fractions after subcooling in exchanger 26. One fraction 71 is further subcooled in exchanger 27 in a manner similar to stream 31 in the first embodiment. The pressure of the subcooled liquid stream 77 from exchanger 27 is reduced to a level approximately equal to that of stream 50 and slightly above that of stream 12, for example, with a valve 78. Stream 77 is flashed, and the resulting stream 79 is then combined with the vaporized stream 50, and the combined stream 80 enters exchanger 27 where it is at least partially vaporized to form stream 82. The other fraction, stream 72, is flashed across valve 75 to a pressure approximately equal to that of stream 82. The resulting stream 76 is combined with the partially warmed and vaporized stream 82 that exits the exchanger 27. The combined stream 83 then provides refrigeration duty to exchanger 26. The second embodiment depicted in FIG. 2 provides a greater degree of control over the relative cooling duties of exchangers 26 and 27 than does the first embodiment shown in FIG. 1. All other steps and processes in FIG. 2 are similar in nature to those described for FIG. 1.

Thus, in the embodiment of FIG. 2, in aforesaid step (c) of the method of this invention the entire at least partially condensed vapor stream is cooled to produce in at least one step the subcooled liquid stream, and in aforesaid step (e) a portion of the cooled depressurized liquid stream from step (b) is combined with the at least partially vaporized stream from aforesaid step (d) before it undergoes further heating, to thereby form a first combined stream, which after further heating is combined with the remainder of the cooled depressurized stream from such step (b), to thereby form a second combined stream which has the aforesaid preselected composition.

FIG. 3 depicts a third embodiment of this invention. Again, many of the streams and process steps in FIG. 3 are similar in function to those in FIG. 1. Streams, exchangers, drums, columns, valves, and compressors in FIG. 3 that serve the same or similar functions to those in FIG. 1 are numbered the same as those in FIG. 1. Only those aspects of the third embodiment (FIG. 3) that are different from the first embodiment (FIG. 1) are discussed below.

There are two differences in the third embodiment shown in FIG. 3 as compared with the first shown in FIG. 1. The first difference is that the vapor and liquid of the cooled stream 30 are separated between exchangers 26 and 27. Thus, stream 30 represents the partially condensed stream 30 after it has been cooled and partially condensed in 26. The vapor and liquid are separated in drum 87 to form the relatively light vapor stream 88 and the relatively heavy liquid stream 89. Stream 88 is cooled in exchanger 27 to produce the stream 90. Like stream 45 in the first embodiment in FIG. 1, stream 90 can be partially condensed, fully condensed, or a subcooled liquid depending on the composition of stream 88 and the design of 27 and can be treated exactly as is stream 45 in FIG. 1. Stream 89 is cooled in exchanger 27, and the resulting stream 91 is flashed through valve 92 to produce stream 93 which is then combined with stream 50 to produce stream 94 which is then partially vaporized in exchanger 27.

The second difference between the third and first embodiments is that stream 31, the liquid from the first vapor/liquid separation step, is completely flashed after subcooling in 26. Thus, the subcooled liquid stream 31 is flashed across valve 96 to a pressure near that of stream 95 from the exchanger 27. The resulting flashed stream is combined with stream 95, which is the partially warmed and vaporized stream 94 that exits exchanger 27. The combined stream 98 then provides refrigeration duty to exchanger 26.

All other steps and processes in FIG. 3 are similar in function to those described for FIG. 1. Like the second embodiment, the third embodiment depicted in FIG. 3 provides a greater degree of control over the relative cooling duties of the exchangers 26 and 27 than does the first embodiment. In addition, the refrigerant stream going to the demethanizer condenser in the third embodiment (stream 90) is lighter than the corresponding stream in the first embodiment (stream 45), thereby providing refrigeration at a lower temperature.

Thus, in the embodiment of FIG. 3, in aforesaid step (c) of the method of this invention the aforesaid vapor portion is cooled to produce in at least one step the subcooled liquid stream, and in aforesaid step (e) the cooled depressurized liquid portion of the aforesaid partially condensed vapor stream from aforesaid step (c) is combined with the at least partially vaporized stream from aforesaid step (d) before it undergoes further heating, to thereby form a first combined stream, which after further heating is combined with the cooled depressurized stream from such step (b), to thereby form a second combined stream which has the aforesaid preselected composition.

Other modifications to the refrigeration systems depicted in FIGS. 1–3 can be envisioned by those skilled in the art. They are all contained within the scope and spirit of the invention depicted in FIGS. 1–3.

The present invention will be more clearly understood from the following specific examples.

EXAMPLE 1

Figure 4:
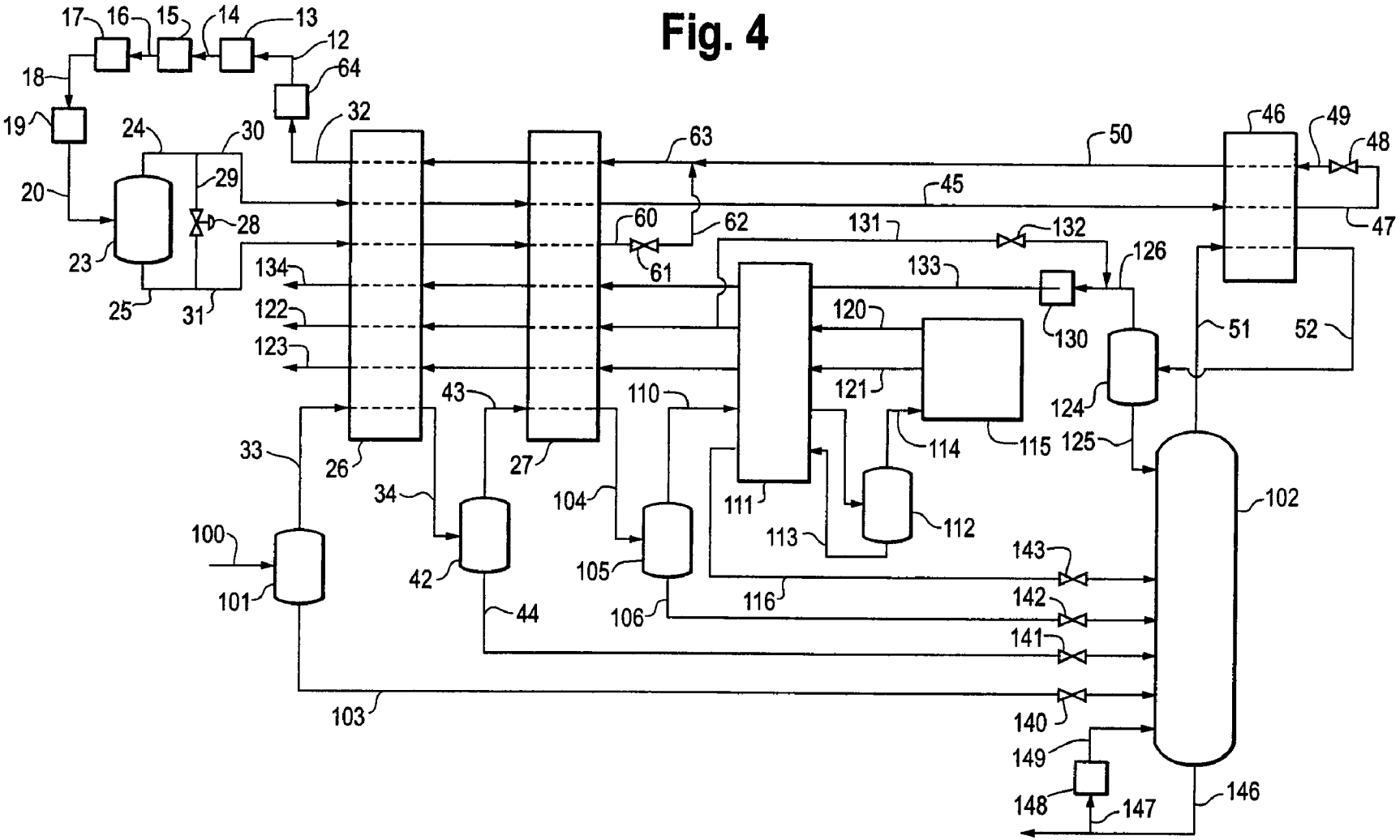
FIG. 4 is a schematic illustration of an embodiment of this invention for providing refrigeration to a separation process for the recovery of ethylene from a hydrocarbon cracker, as illustrated in Example 1.

A mixed refrigerant system identical to the first embodiment described above and shown in FIG. 1 was simulated using a commercially-available process simulation package. It provides refrigeration for an ethylene plant producing 500 thousand tons per year of ethylene from a mixed feed cracker. The refrigeration system and process chilling steps of this example are shown in FIG. 4. In this example the process stream to be cooled is the vapor fraction of a chilled deethanizer overhead stream. All stream and equipment numbers relating to the refrigeration system of this example correspond to those in FIG. 1. Stream composition and flow data for the refrigeration system streams of FIG. 4 are presented in Table 1, and composition and flow data for the process streams are presented in Table 2. Heat exchanger duties are given in Table 3.

The process feed stream in this example (stream 100) has had essentially all of the C3 and C4 and heavier hydrocarbons removed (i.e., it is the overhead vapor of a deethanizer column). It has additionally been treated in an acetylene converter so that essentially all of the acetylene has been removed. A typical composition for this stream is given in Table 1.

A ternary mixed refrigerant is used in this example, consisting of approximately 35 mole percent methane, 55 mole percent ethane, and 10 mole percent propane. The mixed refrigerant is compressed to about 350 psia in two stages of compression (13 and 17), and then cooled in a series of five heat exchangers (represented as the single exchanger 19 in FIG. 4). The five heat exchangers in series are designated as 19*a*, 19*b*, 19*c*, 19*d* and 19*e* in Table 3. The individual duties of these heat exchangers are given in Table 3. The initial heat rejection is to cooling water (in exchanger 19*a* of Table 3). The second stage of cooling (19*b*) is provided by 50° F. refrigerant from a separate propylene refrigeration system. The third step of cooling (19*c*) is provided by the reboiler on the C2 splitter column of the ethylene purification train (not shown in FIG. 4). This reduces the temperature of the mixed refrigerant stream to approximately 20° F. The fourth stage of cooling (19*d*) takes place against a vaporizing light hydrocarbon feed that enters the cracker complex as a liquid. This fourth stage of cooling reduces the temperature

TABLE 1

Flows and Conditions for Refrigeration System Streams of Example 1 (FIG. 4)

| | Stream No. | | | | | | | | | | |
|---|---|---|---|---|---|---|---|---|---|---|---|
| | 12 | 20 | 24 | 25 | 32 | 45 | 47 | 49 | 50 | 60 | 63 |
| Temperature (Deg F.) | 64.5 | −40.0 | −40.0 | −40.0 | −45.9 | −159.0 | −170.0 | −198.5 | −168.0 | −159.0 | −156.9 |
| Pressure (psig) | 59 | 339 | 339 | 339 | 61 | 337 | 336 | 65 | 63 | 337 | 63 |
| Vapor Fraction | 1.00 | 0.25 | 1.00 | 0.00 | 1.00 | 0.00 | 0.00 | 0.14 | 0.60 | 0.00 | 0.13 |
| Molar flows (lb mol/hr) | | | | | | | | | | | |
| Methane | 2132 | 2132 | 1111 | 1021 | 2132 | 1111 | 1111 | 1111 | 1111 | 1021 | 2132 |
| Ethane | 3628 | 3628 | 456 | 3172 | 3628 | 456 | 456 | 456 | 456 | 3172 | 3628 |
| Propane | 679 | 679 | 22 | 657 | 679 | 22 | 22 | 22 | 22 | 657 | 679 |

TABLE 2

Flows and Conditions for Process Streams of Example 1 (FIG. 4)

| | Stream No. | | | | | | | |
|---|---|---|---|---|---|---|---|---|
| | 100 | 103 | 33 | 44 | 43 | 106 | 110 | 113 |
| Temperature (Deg F.) | −39.9 | −39.9 | −39.9 | −95.0 | −95.0 | −165.0 | −165.0 | −230.0 |
| Pressure (psig) | 518 | 518 | 518 | 514 | 514 | 512 | 512 | 510 |
| Vapor Fraction | 0.79 | 0.00 | 1.00 | 0.00 | 1.00 | 0.00 | 1.00 | 0.00 |
| Molar flows (lb mol/hr) | | | | | | | | |
| CO | 23.3 | 0.9 | 22.4 | 2.0 | 20.4 | 1.1 | 19.3 | 1.2 |
| Hydrogen | 4483.9 | 69.8 | 4414.1 | 98.6 | 4315.5 | 25.9 | 4289.6 | 10.7 |
| Methane | 1406.4 | 135.9 | 1270.4 | 317.2 | 953.3 | 219.9 | 733.3 | 263.4 |
| Ethylene | 4510.9 | 1493.5 | 3017.4 | 2204.7 | 812.7 | 695.1 | 117.6 | 113.0 |
| Ethane | 1963.3 | 848.6 | 1114.7 | 922.0 | 192.7 | 178.9 | 13.8 | 13.6 |
| Acetylene | 0.0 | 0.0 | 0.0 | 0.0 | 0.0 | 0.0 | 0.0 | 0.0 |
| Propylene | 2.7 | 1.9 | 0.7 | 0.7 | 0.0 | 0.0 | 0.0 | 0.0 |

| | Stream No. | | | | | | | |
|---|---|---|---|---|---|---|---|---|
| | 114 | 120 | 121 | 51 | 125 | 126 | 131 | 133 |
| Temperature (Deg F.) | −230.0 | −235.0 | −235.0 | −169.4 | −184.5 | −184.5 | −169.3 | −243.4 |
| Pressure (psig) | 510 | 506 | 46 | 190 | 189 | 189 | 504 | 48 |
| Vapor Fraction | 1.00 | 1.00 | 1.00 | 1.00 | 0.00 | 1.00 | 1.00 | 0.99 |
| Molar flows (lb mol/hr) | | | | | | | | |
| CO | 18.1 | 13.4 | 4.7 | 5.7 | 0.5 | 5.2 | 4.0 | 9.2 |
| Hydrogen | 4278.9 | 3628.0 | 650.9 | 207.6 | 2.6 | 205.0 | 1088.4 | 1293.4 |
| Methane | 469.9 | 118.0 | 351.9 | 1428.5 | 492.3 | 936.2 | 35.4 | 971.6 |

TABLE 2-continued

| Flows and Conditions for Process Streams of Example 1 (FIG. 4) | | | | | | | | |
|---|---|---|---|---|---|---|---|---|
| Ethylene | 4.6 | 0.0 | 4.6 | 43.3 | 37.6 | 5.7 | 0.0 | 5.7 |
| Ethane | 0.2 | 0.0 | 0.2 | 0.3 | 0.2 | 0.0 | 0.0 | 0.0 |
| Acetylene | 0.0 | 0.0 | 0.0 | 0.0 | 0.0 | 0.0 | 0.0 | 0.0 |
| Propylene | 0.0 | 0.0 | 0.0 | 0.0 | 0.0 | 0.0 | 0.0 | 0.0 |

TABLE 3

| Heat Exchanger Duties | |
|---|---|
| Exchanger | Net Duty (MMBTU/hr) |
| 15 | −7.00 |
| 19a | −6.35 |
| 19b | −4.02 |
| 19c | −9.50 |
| 19d | −17.93 |
| 19e | −1.31 |
| 26[1] | −19.55 |
| 27[2] | −8.42 |
| 46[3] | −1.77 |
| 64 | 8.08 |
| 111[4] | −3.91 |
| 148 | 9.52 |

[1]Net chilling duty to stream 33
[2]Net chilling duty to stream 43
[3]Net chilling duty to stream 51
[4]Net chilling duty to stream 110 of the mixed refrigerant stream to approximately −26° F. The final stage of cooling (19*e*) is provided by −45° F. refrigerant from the separate propylene refrigeration system.

After the final stage of chilling the mixed refrigerant stream is approximately 25 percent vapor. The vapor and liquid are separated in drum 23 and both the vapor and liquid enter the main mixed refrigerant heat exchangers 26 and 27. Stream 29 is not used in this example. Both the vapor and liquid streams are chilled to approximately −160° F. to produce streams 45 and 60, respectively. Stream 45 is further cooled in the demethanizer condenser 46 to produce a subcooled liquid stream 47 at approximately −170° F. This stream is flashed across valve 48 to approximately 65 psia and then directed back through exchanger 46 where it is partially vaporized to provide refrigeration duty for the demethanizer condenser.

The subcooled liquid stream 60 is flashed across valve 61 to approximately 63 pounds per square inch absolute and the flashed stream 62 is combined with the partially vaporized stream 50 to form combined stream 63. This stream is directed back to exchangers 26 and 27 where it is completely vaporized to form stream 32. This stream is reheated in 64 against subcooling liquid refrigerant from a separate refrigeration system before re-entering the first compression stage. The total compression power requirement for this system is approximately 5,280 horsepower: around 3,380 horsepower for the first stage of compression, and around 1,900 hp for the second stage of compression.

The process stream to be chilled, stream 100, is the overhead vapor of a deethanizer column which has been chilled to −40° F. against propylene refrigerant. The vapor and liquid in stream 100 are separated in drum 101. The liquid is directed to the demethanizer column 102 as stream 103, and the uncondensed vapor stream 33, is directed through exchanger 26 where it is cooled and partially condensed. The vapor and liquid in stream 34 are separated in drum 42, and the liquid sent to the demethanizer column as stream 44. The uncondensed vapor from 42, stream 43, is further cooled and partially condensed in exchanger 27. The vapor and liquid of the resulting mixed phase stream 104 are separated in drum 105, and the liquid, stream 106, is directed to 102. The vapor, stream 110, is further cooled and partially condensed in exchanger 111. The vapor and liquid are separated in 112. The liquid, stream 113, is reheated in exchanger 111. The vapor stream 114 contains primarily hydrogen and methane and is sent to a typical one-stage adiabatic hydrogen purification section 115. The heated stream 116 from exchanger 111 is directed to demethanizer 102.

Operation of the adiabatic hydrogen purification section is well-known to those skilled in the art, and it results in the production of two streams: a relatively high pressure purified hydrogen stream, stream 120, and a relatively low pressure methane-rich stream, stream 121. These streams are reheated in exchangers 111, 27 and 26 to produce the reheated streams 122 and 123, respectively. These streams would typically be further reheated elsewhere in the plant.

The gross overhead of the demethanizer column 102, stream 51, is partially condensed in exchanger 46, and the resulting vapor and liquid are separated in drum 124. The demethanizer bottoms is withdrawn in stream 146, a portion of which is removed in stream 147 and reheated in reboiler 148 and reinjected as stream 149 into the bottom portion of demethanizer 102 as stripping vapor. The liquid from 124, stream 125, is returned to the top of 102 as reflux. The uncondensed vapor, stream 126, is directed through expander 130. If required by the heat balance of the cold box, a fraction of the partially reheated high-pressure hydrogen stream 120 can also be directed to the expander inlet, indicated as stream 131. Depending on the relative pressures of the demethanizer and hydrogen purification section, the pressure of stream 131 may need to be reduced as, with valve 132 in FIG. 4. Another stage of expansion could also be used in place of valve 132. The cold expanded stream, stream 133, is reheated in exchangers 111, 27 and 26 to provide refrigeration duty to these exchangers. It should be noted that if the pressure of the demethanizer is significantly lower than that of the drums 101, 42, 105, and 112, the pressure of the liquid feeds to the demethanizer will have to be reduced, as shown with valves 140–143.

EXAMPLE 2

This example describes the use of the mixed refrigeration system of this invention in the chilling and demethanization of the offgas stream from a refinery fluidized catalytic cracking (FCC) unit. A mixed refrigerant system shown in FIG. 5 was simulated using commercially available process simulation software. The refrigeration system provides refrigeration to the FCC offgas recovery process, the goal of which is to recover C2+ liquids from the FCC offgas stream. The process feed stream in this example has been treated to remove water and other contaminants (such as trace metals and carbon dioxide) that could impact the operation of the FCC offgas recovery unit. In this example all stream and equipment numbers relating to the refrigeration system correspond to those in FIG. 1, except that the exchanger 64 is not employed. Stream compositions and flowrates for the refrigerant streams of Example 2 are presented in Table 4, and the stream compositions and flow rates for the process streams of Example 2 are presented in Table 5. Heat exchanger duties are given in Table 6.

The dried FCC offgas stream, stream 150, enters the mixed refrigerant cold box after being chilled to −35° F. with a separate propylene refrigeration system. It passes through the main mixed refrigerant heat exchanger 26, is partially condensed, and exits as stream 151. This stream is directed as feed to the demethanzer tower 152. A mixed refrigerant stream consisting of approximately 40 mole percent methane, 20 mole percent ethane, 20 mole percent ethylene, and 20 mole percent propane is used. A mixture of ethane and ethylene is used in this case, since pure ethane or pure ethylene may not be readily available in a refinery environment. The optimum composition of the mixed refrigerant will depend on the process gas to be cooled, the temperature range desired, the availability of the various components, and many other factors.

Figure 5:
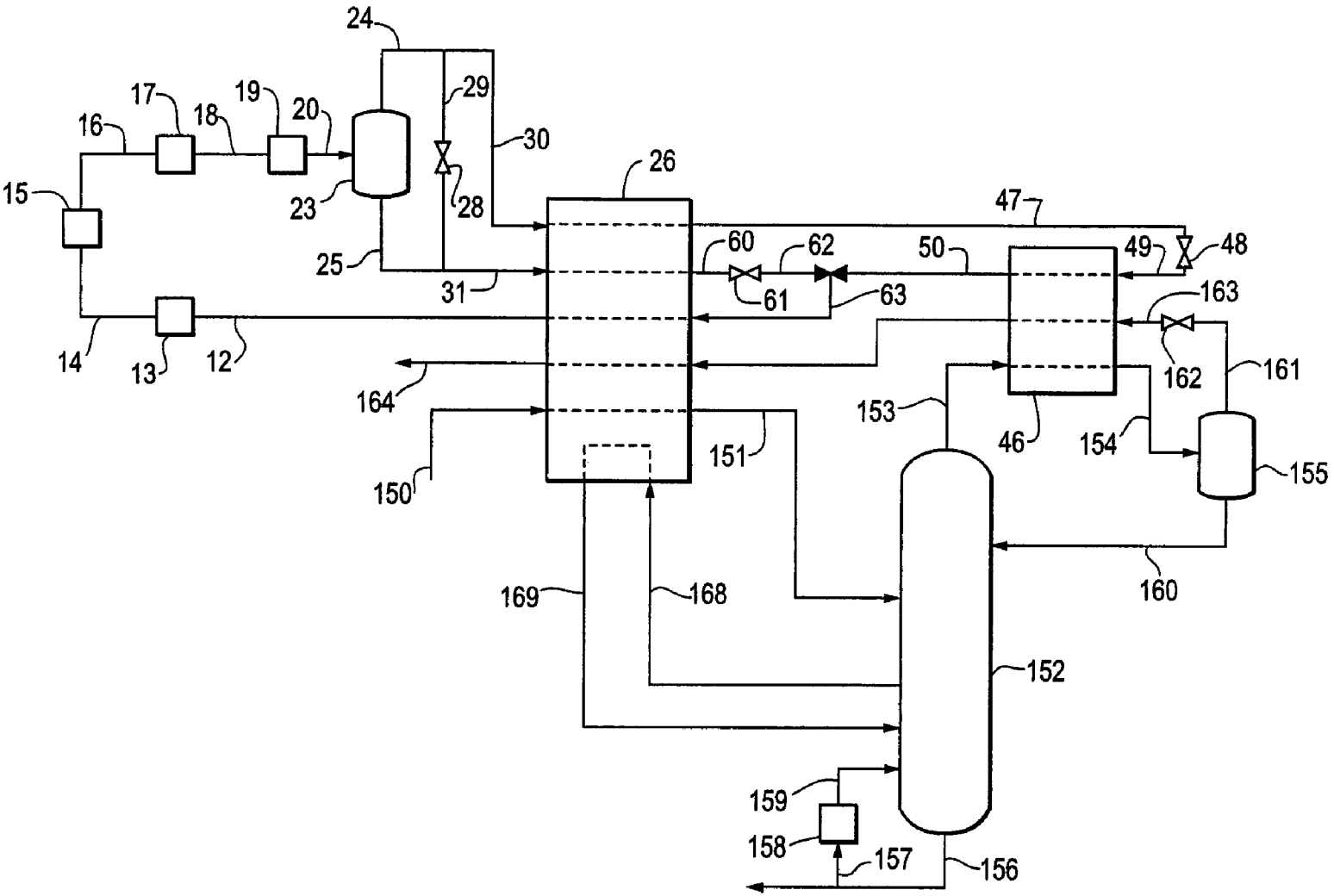
FIG. 5 is a schematic illustration of an embodiment of this invention for providing refrigeration to a fluidized catalytic cracking offgas recovery process, as illustrated in Example 2.

The gaseous mixed refrigerant, stream 12, is compressed to 450 psia in two stages, 13 and 17. An intercooler 15 is used between the compression stages. The compressed stream 18 is then cooled in a series of heat exchangers (19*a*, 19*b*, 19*c* and 19*d*) that are represented in FIG. 5 as the single exchanger 19. The individual duties of these various heat exchangers are given in Table 6. The initial cooling (19*a* in Table 6) is provided by cooling water. The second stage of cooling (19*b*) is provided by 10° F. refrigerant from a separate propylene refrigeration system. The third step of cooling (19*c*) is provided by the reboiler 158 on the demethanizer column. This reduces the temperature of the mixed refrigerant stream to approximately −2° F. The final stage of cooling (19*d*) is provided by −40° F. refrigerant from a separate propylene refrigeration system.

TABLE 4

Flows and Conditions for Refrigeration System Streams of Example 2 (FIG. 5)

| | Stream No. | | | | | | | | | |
|---|---|---|---|---|---|---|---|---|---|---|
| | 12 | 20 | 30 | 31 | 47 | 49 | 50 | 60 | 62 | 63 |
| Temperature (Deg F.) | −59.9 | −35.0 | −35.0 | −35.0 | −170.0 | −218.9 | −170.0 | −170.0 | −181.1 | −176.9 |
| Pressure (psig) | 42 | 442 | 442 | 442 | 441 | 45 | 44 | 441 | 44 | 44 |
| Vapor Fraction | 1.00 | 0.32 | 1.00 | 0.00 | 0.00 | 0.23 | 0.78 | 0.00 | 0.07 | 0.30 |
| Molar flows (lb mol/hr) | | | | | | | | | | |
| METHANE | 1380 | 1380 | 798 | 582 | 798 | 798 | 798 | 582 | 582 | 1380 |
| ETHYLENE | 690 | 690 | 164 | 526 | 164 | 164 | 164 | 526 | 526 | 690 |
| ETHANE | 690 | 690 | 115 | 575 | 115 | 115 | 115 | 575 | 575 | 690 |
| PROPANE | 690 | 690 | 32 | 657 | 32 | 32 | 32 | 657 | 657 | 690 |

TABLE 5

Flows and Conditions for Process Streams of Example 2 (FIG. 5)

| | Stream No | | | | | | | | | |
|---|---|---|---|---|---|---|---|---|---|---|
| | 150 | 151 | 153 | 154 | 160 | 161 | 163 | 164 | 168 | 169 |
| Temperature (Deg F.) | −35.0 | −145.0 | −166.6 | −204.3 | −204.3 | −204.3 | −205.3 | −40.0 | −121.2 | −40.0 |
| Pressure (psig) | 147 | 144 | 134 | 134 | 134 | 134 | 125 | 122 | 136 | 136 |
| Vapor Fraction | 0.99 | 0.66 | 1.00 | 0.85 | 0.00 | 1.00 | 1.00 | 1.00 | 0.00 | 0.70 |
| Molar flows (lb mol/hr) | | | | | | | | | | |
| CO | 34 | 34 | 35 | 35 | 1 | 34 | 34 | 34 | 0 | 0 |
| H2 | 1226 | 1226 | 1228 | 1228 | 2 | 1226 | 1226 | 1226 | 0 | 0 |
| N2 | 431 | 431 | 437 | 437 | 7 | 431 | 431 | 431 | 0 | 0 |
| METHANE | 1713 | 1713 | 2047 | 2047 | 334 | 1713 | 1713 | 1713 | 94 | 94 |
| ETHYLENE | 752 | 752 | 287 | 287 | 249 | 38 | 38 | 38 | 182 | 182 |
| ETHANE | 697 | 697 | 4 | 4 | 4 | 0 | 0 | 0 | 164 | 164 |
| PROPYLEN | 177 | 177 | 0 | 0 | 0 | 0 | 0 | 0 | 39 | 39 |
| PROPANE | 47 | 47 | 0 | 0 | 0 | 0 | 0 | 0 | 10 | 10 |
| C4+ | 100 | 100 | 0 | 0 | 0 | 0 | 0 | 0 | 22 | 22 |

TABLE 6

| Heat Exchanger Duties | |
|---|---|
| Exchanger | Net Duty (MMBTU/hr) |
| 15 | −3.79 |
| 19a | −2.72 |
| 19b | −8.95 |
| 19c | −2.45 |
| 19d | −4.53 |
| 26[1] | −14.61 |
| 46[2] | −3.67 |
| 158 | 2.45 |

[1]Net chilling duty to stream 150
[2]Net chilling duty to stream 153

At this point the temperature of the mixed refrigerant stream 20 is −35° F., and the stream is approximately 30 percent vapor. The vapor and liquid are separated in drum 23. There is no flow in stream 29 in this example. The vapor stream (stream 24) and the liquid stream (stream 25) both enter the main mixed refrigerant heat exchanger 26 and are cooled to −170° F. This produces a lighter subcooled liquid stream 47, and a heavier subcooled liquid stream 60, respectively. The lighter stream is flashed across valve 48 to about 45 psia and the flashed stream 49 is directed to the demethanizer condenser, 46. Stream 49 is heated and partially vaporized in exchanger 46 to produce stream 50, thereby providing refrigeration for the demethanizer condenser. The gross demethanizer overhead stream, stream 153, also enters exchanger 46 and is partially condensed to form stream 154. The vapor and liquid are separated in drum 155. The demethanizer bottoms are withdrawn in stream 156, a portion of which is removed in stream 157 and heated in reboiler 158 and reinjected as stream 159 into the bottom portion of demethanizer 152 as stripping vapor. The liquid stream from 155, stream 160 is directed back to the demethanizer column 152 as reflux liquid, and the vapor stream 161 is flashed across valve 162 to a lower pressure, and the resulting stream 163 is reheated through exchangers 46 and 26 and to form the final light gas stream 164.

The subcooled relatively heavy liquid, stream 60, is flashed across valve 61 to approximately 45 psia. The resulting stream 62 is then combined with the partially vaporized relatively light stream 50 from the demethanizer condenser to form the combined stream 63. This stream is directed back to exchanger 26 where it is completely vaporized to provide refrigeration duty for the chilling of the process stream 150. The completely vaporized stream returns as stream 12 to the first stage of compression. Exchanger 26 also includes a liquid reheat stream from the demethanizer column, which enters the exchanger from the demethanizer as liquid stream 168 and returns to the demethanizer as partially vaporized stream 169. It should be noted that the utility of this feature and the other details of the process gas chilling are highly dependent on the conditions and composition of the process gas stream and the demethanizer configuration. The total compression power requirement for the refrigeration system of this example is approximately 4210 hp; approximately 3,440 hp for the first stage of compression, and approximately 770 hp for the second stage of compression.

While the invention is described in connection with the specific examples, it is to be understood that these are for illustrative purposes only. Many alternatives, modifications and variations will be apparent to those skilled in the art in the light of the above examples, and such alternatives, modifications and variations fall within the spirit and scope of the appended claims.

What is claimed is:

1. In the recovery of ethylene from a feed gas comprising methane, ethylene, and hydrogen wherein the recovery comprises the steps of compressing and cooling the feed gas to condense a portion thereof, fractionating the resulting condensed feed gas liquid in at least one demethanizer column to recover a light overhead product comprising substantially hydrogen and methane, and recovering an ethylene-containing product from the bottoms stream from the at least one demethanizer column, wherein cooling and demethanization of the feed gas is provided by a refrigeration process comprising the steps of:

(a) compressing from a first pressure to a second pressure a gaseous mixed refrigerant stream comprising methane, ethane and/or ethylene, and propane and/or propylene having a preselected composition;

(b) cooling and partially condensing the aforesaid mixed refrigerant stream and separating a vapor refrigerant stream having an increased percentage of methane and a liquid refrigerant stream having an increased percentage of propylene and/or propane;

(c) cooling the vapor stream from step (b) to produce an at least partially condensed vapor stream and cooling at least the vapor portion thereof to produce in at least one step a subcooled liquid stream;

(d) flashing the subcooled liquid stream from step (c) to a third pressure which is above the aforesaid first pressure and at least partially vaporizing the resulting depressurized stream by indirect heat exchange with the demethanizer overhead to thereby provide refrigeration for the demethanizer condenser;

(e) cooling the liquid stream from step (b) and the liquid portion if any, of the aforesaid partially condensed vapor stream from step (c), flashing them to the aforesaid third pressure, and combining them with the at least partially vaporized stream from step (d) either before or after or both before and after the at least partially vaporized stream from step (d) undergoes further heating, to thereby form an at least partially vaporized combined stream having the aforesaid preselected composition;

(f) completely vaporizing the combined stream from step (e) by indirect heat exchange thereof with the feed gas to thereby provide refrigeration to cool the feed gas; and (g) recycling the completely vaporized mixed refrigerant stream from step (f) to step (a).

2. The process of claim 1 wherein in step (c) the entire at least partially condensed vapor stream is cooled to produce in at least one step the subcooled liquid stream, and in step (e) the entire cooled flashed liquid stream from step (b) is combined with the at least partially vaporized stream from step (d) before the stream from step (d) undergoes further heating to thereby form a combined stream having the aforesaid preselected composition.

3. The process of claim 1 wherein in step (c) the entire at least partially condensed vapor stream is cooled to produce in at least one step the subcooled liquid stream, and in step (e) a portion of the flashed stream from step (b) is combined with the at least partially vaporized stream from step (d) before it undergoes further heating, to thereby form a first combined stream, which after further heating is combined with the remainder of the cooled depressurized stream from step (b), to thereby form a second combined stream which has the aforesaid preselected composition.

4. The process of claim 1 wherein in step (c) the aforesaid vapor portion is cooled to produce in at least one step the subcooled liquid stream, and in step (e) the cooled flashed liquid portion of the aforesaid partially condensed vapor stream from step (c) is combined with the at least partially vaporized stream from step (d) before it undergoes further heating, to thereby form a first combined stream, which after further heating is combined with the cooled flashed stream from step (b), to thereby form a second combined stream which has the aforesaid preselected composition.

5. The process of claim 1 wherein the feed gas comprises from 3 to 50 mole percent of methane, from 10 to 45 mole percent of ethylene, and from 5 to 50 mole percent of hydrogen.

6. The process of claim 1 wherein the feed gas comprises cracked gas from a hydrocarbon cracker.

7. The process of claim 6 wherein the feed gas comprises from 15 to 50 mole percent of methane, from 10 to 30 mole percent of ethylene, and from 5 to 25 mole percent of hydrogen.

8. The process of claim 1 wherein the feed gas comprises the offgas stream from a refinery fluidized catalytic cracking unit.

9. The process of claim 8 wherein the feed gas comprises from 3 to 35 mole percent of methane, from 20 to 45 mole percent of ethylene, and from 10 to 50 mole percent of hydrogen.

* * * * *